US005490638A

United States Patent [19]

Driftmyer et al.

[11] Patent Number: 5,490,638

[45] Date of Patent: Feb. 13, 1996

[54] RIBBON TENSION CONTROL WITH DYNAMIC BRAKING AND VARIABLE CURRENT SINK

[75] Inventors: James F. Driftmyer; Robert F. Jessen, Endwell; George Melnyk, Endicott, all of N.Y.

[73] Assignee: International Business Machines Corporation, Armonk, N.Y.

[21] Appl. No.: 843,875

[22] Filed: Feb. 27, 1992

[51] Int. Cl.[6] ..... B65H 77/00

[52] U.S. Cl. ..... 242/421; 242/422.2

[58] Field of Search ..... 242/75.44, 75.47, 242/75.51, 75.5, 186, 189, 190, 421, 421.4, 422.2; 318/6, 7, 375, 376, 381, 360, 762, 759, 8788; 400/225, 234, 902

[56] References Cited

U.S. PATENT DOCUMENTS

| | | | |
|---|---|---|---|
| 3,365,642 | 1/1968 | Risberg | 318/376 |
| 3,463,991 | 8/1969 | Yuminaka et al. | 318/375 |
| 3,501,684 | 3/1970 | Webb | 318/379 |
| 3,728,599 | 4/1973 | Minami | 318/376 X |
| 3,995,204 | 11/1976 | Konrad et al. | 318/373 X |
| 4,051,421 | 9/1977 | Brinner et al. | 318/376 X |
| 4,081,735 | 3/1978 | Bray | 318/764 X |
| 4,095,154 | 6/1978 | Williamson | 318/376 |
| 4,157,488 | 6/1979 | Allan | 242/186 X |
| 4,163,191 | 7/1979 | Kiwaki et al. | 318/139 X |
| 4,294,552 | 10/1981 | Mako | 400/225 |
| 4,573,645 | 3/1986 | Harris | 242/75.47 |
| 4,749,933 | 6/1988 | ben-Aaron | 318/810 |
| 4,761,600 | 8/1988 | D'Atre et al. | 318/760 X |

OTHER PUBLICATIONS

IBM Technical Disclosure Bulletin, vol. 32, No. 6, Nov., 1989, "Switchable Stepper Motor Drag Control", by Burke et al.

IBM Technical Disclosure Bulletin, vol. 19, No. 11, Apr., 1977, "Use Of Stepper Motor As Variable Load", by Barnett.

*Primary Examiner*—John P. Darling

*Attorney, Agent, or Firm*—Michael E. Belk

[57] ABSTRACT

A pair of ribbon spools are independently operated by respective motors to rotate in one direction until the ribbon end and then in the opposite direction, and so forth. Spools alternately function as feed and take-up spools and motors as a drive and drag motors, respectively To eliminate excess drag motor cogging, a ribbon tension control system uses dynamic braking of the drag motor, and includes drag circuitry with rectifier bridge circuitry and a constant current sink settable for drawing predefined selectable levels of current from the windings of the drag motor. The motors are polyphase, permanent magnet, stepper motors which, when turned by the ribbon, generate alternating back emf signals in their windings. A full-wave rectifier bridge is connected to each winding of the drag motor with bridge outputs connected to a common sink which is an emitter follower circuit whose current level is set and maintained by an operational amplifier. The current level of the emitter follower circuit is set by adjusting the reference voltage of the amplifier using a resistive voltage divider network connected to a binary switch controlled by a microprocessor with a memory. The microprocessor monitors the back emf signals, periodically adjusts the rotational speed of the drive motor depending on distribution of ribbon, and adjusts the sink based on drag value tables stored in memory.

17 Claims, 2 Drawing Sheets

RIBBON TENSION CONTROL WITH DYNAMIC BRAKING AND VARIABLE CURRENT SINK

FIELD OF THE INVENTION

This invention relates to controlling the linear movement of a web or tape between spools or reels and particularly to a system for controlling the tension of an ink ribbon at the print line in an impact printer.

BACKGROUND OF THE INVENTION

In ribbon feeding systems for impact printers or the like, it is common to provide a ribbon drive mechanism having two spools (one takeup and one supply) each drivable by a step motor. It is also known to operate one step motor as a drag motor for applying tension to the ribbon while the other motor drives the ribbon with the two motors switching functions when the direction of the ribbon feeding is reversed. Examples of such systems may be seen by referring to U.S. Pat. No. 4,294,552 issued to J. Mako Oct. 13, 1981 and U.S. Pat. No. 4,573,645 issued to S. C. Harris on Mar. 4, 1986 and articles published in the IBM Technical Disclosure Bulletin Vol. 32, No. 6B, Nov. 1989 at pp. 430 et seq and Vol. 19, No. 11, April 1977 at pp. 4120 et seq. The underlying operative principle of such systems is that the drag motor functions as an electric generator and the feedback electrical current produced in the drag motor phase windings is applied to a resistive load to produce braking torque which resists the rotation of the supply spool by the pull of the ribbon. In U.S. Pat. No. '645, the dynamic braking of the drag motor is done by intermittently switching transistors for connecting a resistive load across the motor phase windings. The degree of torque is controlled by periodically varying the duty cycle of the load switching signals on the basis of digital duty cycle values stored in a drag look-up table applied to a chop wave generator connected to the switching transistors. The frequency of the chop wave must be high to avoid adversely affecting the use of the back emf signals from the drag motor for controlling ribbon velocity and other purposes.

Simple resistive loading across a motor phase winding produces excessive cogging which stresses the ribbon, causes it to track improperly along the print line and produces mechanical vibrations that cause noise. Additionally, switching resistive loads in and out of connection with motor phase windings at varying frequencies or duty cycles does not control the drag consistently across different rotational motor speeds. Also, frequency and pulse width modulation circuits have been seen to have resonance problems. Such techniques when managed by electronic controllers or microprocessors require more dedicated resources than desired.

SUMMARY OF THE INVENTION

The invention provides an improved ribbon tension control system in which dynamic braking of the drag motor comprises drag circuitry using rectifier bridge circuitry and a variable current sink settable for drawing predefined levels of current from the windings of the drag motor. In the preferred embodiment in which the invention is practiced, the drag motor is a polyphase permanent magnet step motor which, when pulled by the ribbon, generates alternating back emf signals in the windings thereof and the rectification circuitry comprises a full wave rectifier bridge circuitry connected to each winding of the drag motor. The outputs of the rectifier bridge circuits are connected to a common current sink. The current sink is an emitter follower circuit whose current level is set and maintained by an operational amplifier. The current level of the emitter follower circuit is set by setting the reference voltage of the operational amplifier using a resistive voltage divider network connected to a binary switch controlled by a microprocessor using tables of drag values stored in memory. The microprocessor monitors the back emf signals from the drag motor windings and periodically adjusts the rotational speed of the drive motor to various levels dependent on the distribution of the ribbon on the spools and sets the current level of the variable sink based on the drag value tables stored in memory. The drag values in the stored tables are based on various operating parameters incorporated into the drag values or input from external sources such as an operator input or detector devices. In this way, the problem of drag motor cogging is eliminated, utilization requirements imposed on the control microprocessor can be reduced and the complexity needed for duty cycle switching of a resistive load to modulate the back emf signals is eliminated.

The preceding and other objects, features and advantages of the invention will become more readily apparent from the following detailed description of the invention as illustrated in the accompanying drawings.

DETAILED DESCRIPTION OF THE INVENTION

Figure 1:
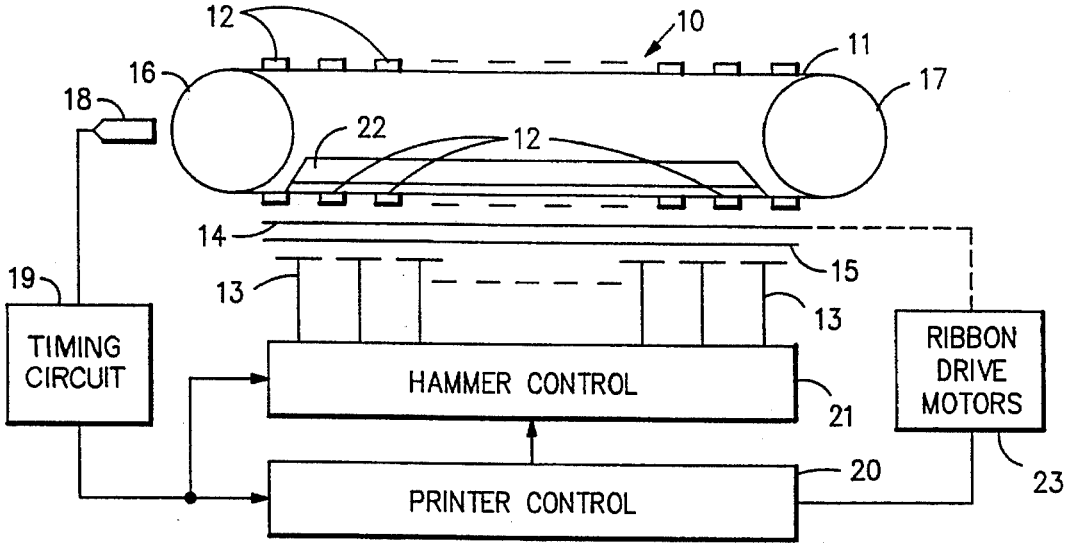
FIG. 1 is a schematic diagram showing the general arrangement of a band printer apparatus in which the invention is utilized.

Although the invention is capable of use in various types of ribbon and tape drives, the detailed description will be made in relation to a high speed impact line printer having an endless steel band as the type carrier.

Referring to the figures, the printer apparatus 10 comprises a continuous type band 11 having a row of engraved type characters 12 facing a row of uniformly spaced print hammers 13. A print medium comprising ink ribbon 14 and paper 15 is interposed between the type band 11 and hammers 13. In accordance with the preferred embodiment in which the invention is practiced, ribbon 14 is a narrow strip or tape, made either of fabric, polyester or other materials. Paper 15 can be a continuous web with edge perforations fed by tractor mechanisms operated by a suitable line feed drive mechanism (not shown). Type band 11 is rotatably supported on spaced pulleys 16 and 17 one of which is connected to a drive motor (not shown) which revolves type band 11 at constant speed during print operation. Characters 12 are formed entirely around the type band 11 and are uniformly spaced. Timing marks (not shown) on the band 11 are sensed by transducer 18 which supplies emitter pulses to timing circuit 19 which generates timing pulses used by printer control 20 for operating the hammer control 21 to selectively fire hammers 13 in timed relation with the motion of the characters 12 to print characters on paper 15. Platen 22 provides backup support to type band 11. Printer control 20 also includes the controls for operating ribbon drive motors 23.

Figure 2:
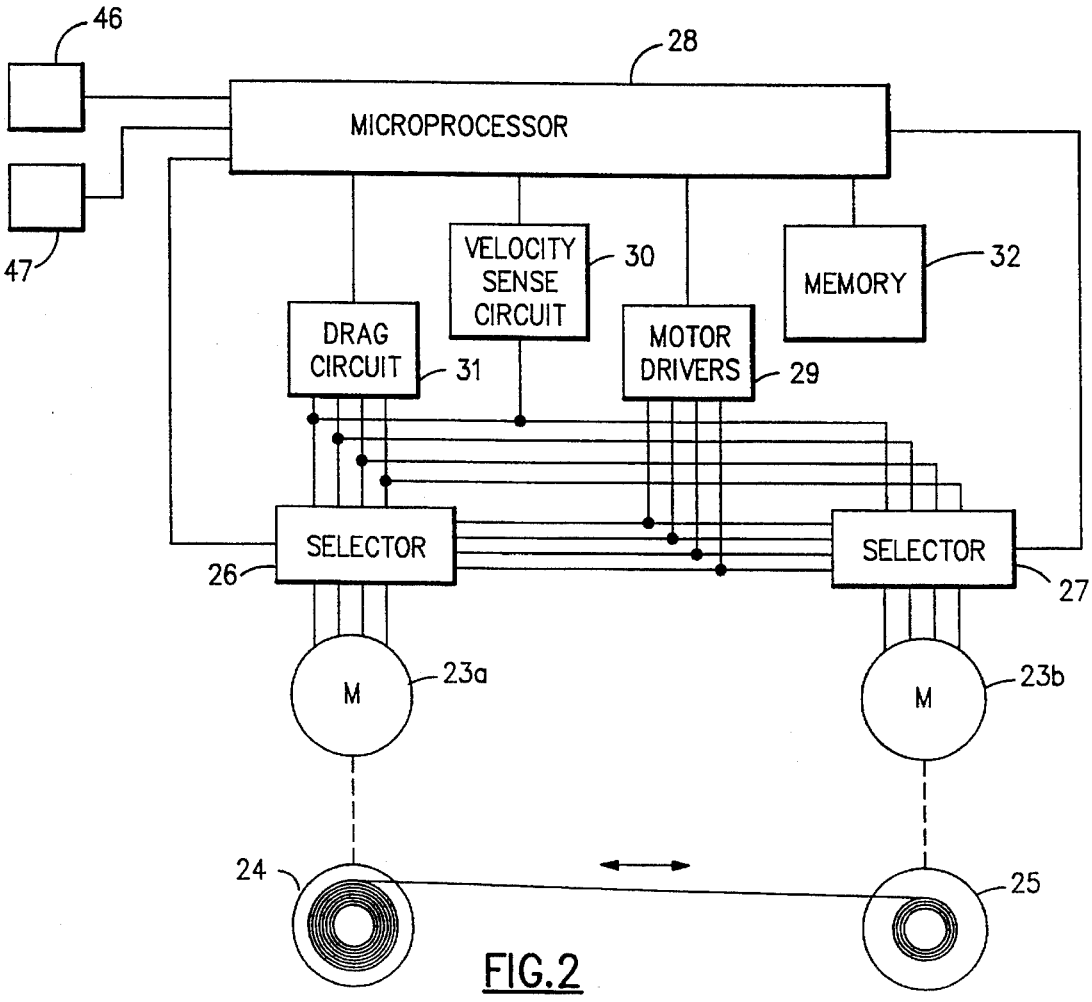
FIG. 2 is a schematic drawing of the ribbon drive portion of the printer control of FIG. 1 which incorporates the invention.

As seen in FIG. 2, ribbon 14 is wound onto a pair of spaced ribbon spools 24 and 25 operatively connected for rotation bidirectionally by motors 23*a* and 23*b*. In the preferred embodiment of the invention, motors 23*a* and 23*b* are polyphase permanent magnet step motors operated to alternately drive their respective spools so that ribbon 14 is transferred from one spool to the other and then reversed each time an end of ribbon is reached.

For instance, as illustrated in FIG. 2, spool 25 is the takeup spool, step motor 23*b* is operated as the drive motor, spool 24 is the supply spool and step motor 23*a* is being pulled or dragged by the ribbon 14 when it is being fed from left to right. When ribbon 14 is fed from right to left, the operation is reversed and spool 24 becomes the takeup spool, step motor 23*a* is the drive motor, spool 25 becomes the supply spool and step motor 23*b* is being pulled or dragged by ribbon 14. When being dragged, the step motors, generate alternating back emf pulses in the phase windings useful for controlling the linear velocity and tension of ribbon 14.

As shown in FIG. 2, the ribbon control system further comprises selector switches 26 and 27 operated by microprocessor 28 to connect the phase windings of motors 23*a* and 23*b* to either motor driver 29 or to velocity sense circuit 30 and drag circuit 31 both of which use the back emf pulses generated by motor. The operation of the selector switches 26 and 27 by microprocessor 28 can be done initially as part of a start up routine resident in microprocessor 28 and activated when the printer apparatus is turned on and thereafter by any well known technique or device for determining or detecting the end of ribbon. As motor 23*b* drives spool 25, ribbon 14 is pulled from supply spool 24 and motor 23*a* is thereby operated as a generator and back emf signals produced in the phase windings thereof are applied to velocity sense circuit 30 and drag circuit 31. As more ribbon 14 is wound onto spool 25, the linear velocity of the ribbon increases which causes the frequency of back emf pulses to increase that are sensed by velocity sense circuit 30. In order to maintain the ribbon speed nearly uniform, microprocessor 28 periodically checks velocity sense circuit 30 compares it with motor speed tables stored in memory 32 and sets the motor driver 29 to apply step pulses at a lower rate to reduce the step rate of motor 23*b* which lowers the linear velocity of the ribbon 14 to the predetermined level. This adjustment may occur one or more times dependent on the original amount of ribbon wound on the takeup spool at the beginning of ribbon drive and the time required for an end of ribbon condition to be detected by microprocessor 28. Thereafter the number of times microprocessor 28 operates motor driver to make changes in the step rate of the selected drive motor can vary depending on the length of the ribbon and how much variation in linear ribbon velocity can be tolerated between changes. In the particular manner in which the invention has been employed, speed tables for as many as five motor step rates are stored in memory for feeding ribbon 14 over its full length of 72 yards fabric ribbon. With this arrangement, linear velocity of the ribbon 14 is maintained within a ten percent of a predetermined speed of 9.5 inches/second.

Figure 3:
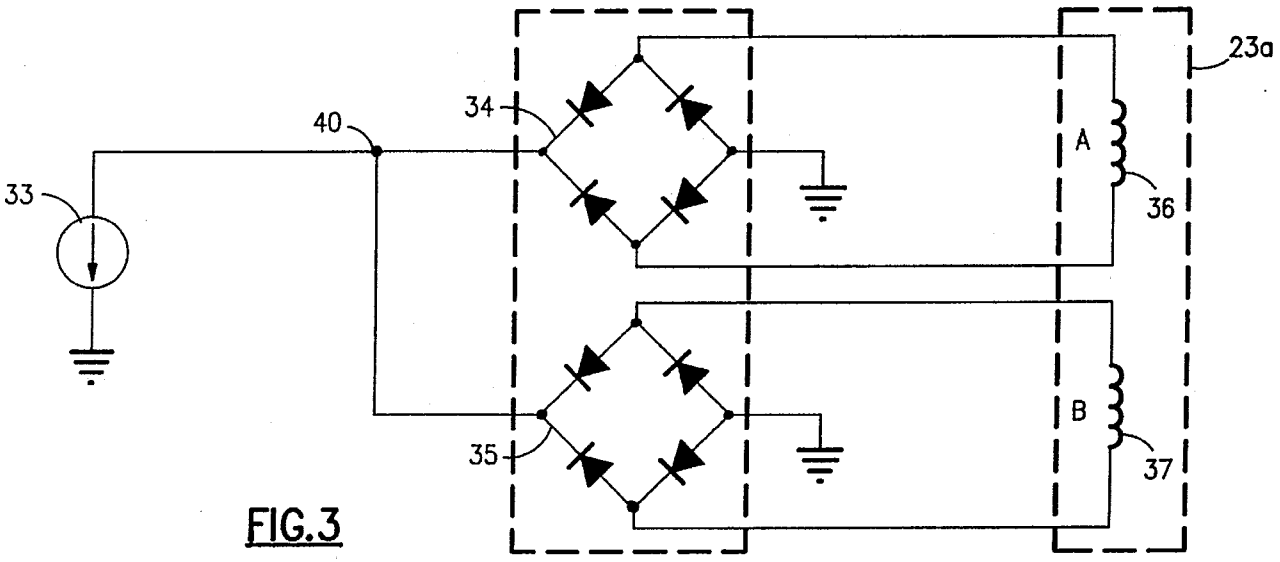
FIG. 3 is a general circuit schematic of the drag circuit portion of FIG. 2 which incorporates the invention.

As previously mentioned, motor 23*a* is dynamically braked by drag circuit 31 to tension ribbon 14. A general schematic of the drag circuit 31 is shown in FIG. 3. Variable current sink 33 is set to the desired current level. A higher current level corresponds to a higher drag on the motor. The paths of the current are through full bridge diode arrays 34 and 35 connected respectively to coil phase windings 36 and 37 of the two phase permanent magnet drag step motor. As the drag step motor is mechanically driven by ribbon 14, the alternating back EMF signals generated in windings 36 and 37 are rectified by the diode arrays 34 and 35 and a positive voltage waveform is generated at circuit node 40. This rectified voltage from the drag motor is used to power the variable current sink 33. As the drag motor is rotated, the current is drawn from each of the phase windings 36 and 37 on the basis of the voltage generated at each phase. Because of the nature of the back emf waveform and the current path set by the diode bridge arrays 34 and 35, proper commutation and drag effect is obtained. Interaction between the phase windings 36 and 37 is eliminated by the dual full bridge diode arrays 34 and 35 thereby eliminating cogging from this interaction. The problem of drag motor cogging experienced with resistive dynamic braking and interference with the use of the back EMF signals by the velocity sense circuit 30 is also eliminated by using this circuitry.

Figure 4:
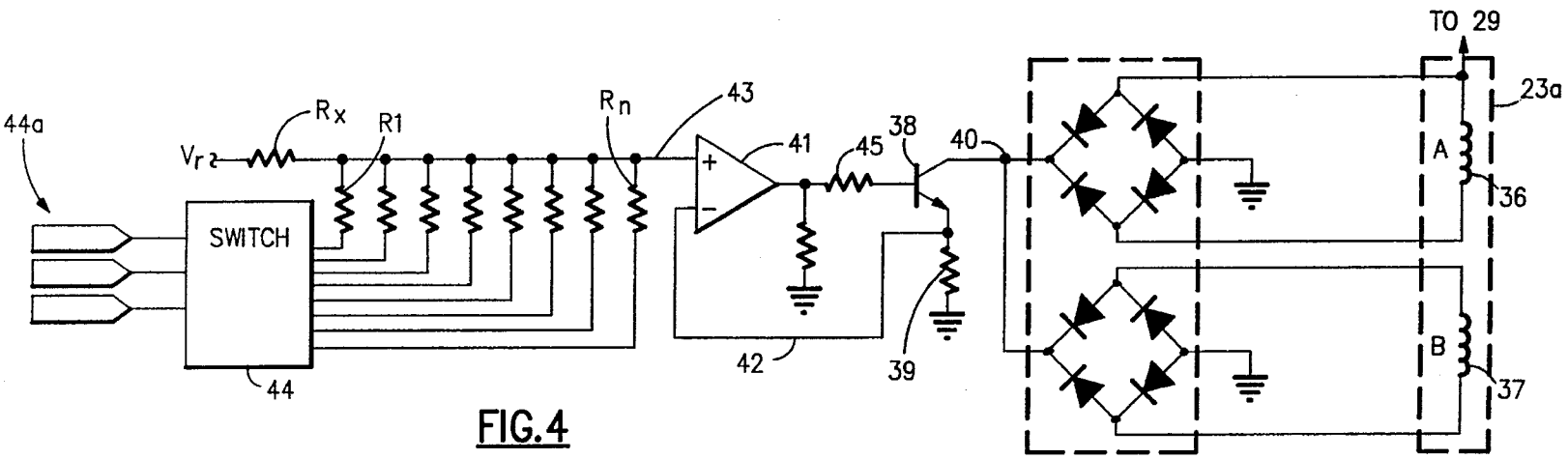
FIG. 4 is a schematic drawing showing greater details of the drag circuit shown in FIG. 3.

As seen in more detail in FIG. 4, variable current sink 33 comprises transistor 38 and load resistor 39 connected in an emitter follower configuration with the collector connected to circuit node 40 and resistor 39 connected to ground and operational amplifier 41 which sets the current level in transistor 38 and load resistor 39. The voltage across load resistor 39 is applied on line 42 to the minus (–) input of operational amplifier 41. A variable reference voltage is supplied on line 43 to the plus (+) input of operational amplifier 41. The control for varying the reference voltage comprises fixed voltage source Vr and voltage divider network comprising register Rx connected between Vr and input line 43 and resistors R1-Rn connected at one end to input line 43 and in various combinations at the other end to ground via binary switch 44.

In the embodiment of this application of the invention, the binary switch 44 consists of a logic device that decodes the multiple digital inputs to select one and only one output. The outputs of binary switch 44 are of an open collector type and the polarity is such that the one output selected is turned on and goes to within a small voltage of ground. The voltage on line 43 is thus determined by the voltage division of the fixed voltage Vr, the load resistance and the one resistor R1-Rn selected by the active output of switch 44. The non-selected outputs of switch 44 are then at high impedance and so their associated resistors do not affect the voltage at line 43.

The resistance values R1-Rn are chosen to set the desired level of current. The minimum resistance value would be zero to set the current sink level and hence the drag value at zero. The maximum useful resistance value would be a value that corresponds to the maximum current sink level that is desired in the application or the maximum current level of the current sink. This latter value would be determined by the motor's back emf constant, the motor rotational speed and the current sink circuit values chosen.

The individual values are chosen empirically to get the desired drag level. The use of the binary switch allows the use of several levels of drag that can be set anywhere in the minimum to maximum range above by the selection of the appropriate resistors.

The operational amplifier 41 applies an output voltage via load resistor 45 to the base of transistor 38 to set the current level in load resistor 39. As is well known in the art, any variation in the load current in resistor 39 is reflected back to the minus input of operational amplifier 41 as a voltage which is compared with the reference voltage on line 43 to the plus input and changes its output to transistor 38 accordingly to restore the load current to the level set by the set reference voltage at the + input value. Thus any variation in the speed of the drag motor during any set speed of the drive motor resulting from changes in the distribution of ribbon 14 on spools 24 and 25 does not change the load current. Any voltage change at node 40 is offset by the operational amplifier 41 operating to maintain the braking current at the level set in current sink 33 on the basis of the reference voltage set on line 43 by resistors R1-Rn selected by switch 44. In this way the current level in sink 33 is held constant until changed by operating binary switch 44 to change the reference voltage on line 43.

In accordance with this invention, setting of the current level of sink circuit 33 is obtained by microprocessor 28 looking up drag values in drag value tables stored in memory in accordance with preselected speed settings indicated by velocity sense circuit 30. The corresponding drag values are used by microprocessor 28 to supply binary switching signals on inputs 44*a* to switch 44 which decodes the input signals and connects the appropriate combination of resistors R1-Rn to ground to set the desired reference voltage on line 43. The drag values stored in the drag tables for the various speeds of the drive motor are essentially empirically derived and are based on other external load factors associated with different modes of printing and type of ribbon. For example, different ribbon materials have different tear strengths and the tension applied by drag motor braking would be selected or modified on the basis of predetermined drag values stored in different sets of drag tables or on the basis of operator or sensor inputs 46 and 47 to microprocessor 28.

Thus it will be seen that an improved ribbon tension control system is provided which has adaptability to a broad range of operating conditions and which is simple in design and effective in eliminating previous problems associated with prior controls which relied on resistive loading of duty cycle switching of resistive loads into phase windings of ribbon drag motors.

While the invention has been particularly shown and described with reference to an impact band line printer, it is to be understood that the invention would be capable of use in other applications where stable tension control of a moving strip or tape is desired and that various changes in detail may be made by persons skilled in the art to adapt the invention for such uses without departing from the spirit and scope of the invention.

We claim:

1. A ribbon drive system including:

a pair of ribbon spools and a pair of motors individually operable to drive said spools, each said motor being alternately operable to drive their respective ribbon spools whereby one motor is a drive motor when the other motor is a driven motor feeding ribbon connected between the spools, said driven motor generating alternating back emf signals in windings of said driven motor in response to motion of said ribbon by said drive motor, and dynamic electrical braking means for producing braking torque by said driven motor for applying tension to said ribbon, comprising:

bridge circuit rectifying means connected to said windings of said driven motor for rectifying said back emf signals, current sink circuit means communicating with the rectifying circuit means for receiving the rectified output of said bridge rectifying circuit means and for maintaining a constant current from windings of the motors at a selected level, and control means for selectively setting the level of current drawn by said current sink from said rectifying means in said current sink circuit means for controlling the level of braking torque produced by said driven motor.

2. A ribbon drive system according to claim 1 wherein said pair of motors are polyphase permanent magnet step motors, said alternating back emf signals are generated in phase windings of said driven step motor, and said bridge circuit means is electronically coupled to the phase winding of said step driven motor and to said current sink means.

3. A ribbon drive system according to claim 2 wherein said step motors are two phase step motors, and said bridge circuit rectifying means are separately coupled to individual phase windings of said driven motor and to said sink circuit means.

4. The system of claim 1 in which the current sink circuit means includes means for establishing a constant current and then maintaining the selected constant current as the motors rotate.

5. In a ribbon drive system for a printer device having a drag motor for tensioning a ribbon and dynamic braking circuit means for controlling the tensioning of said ribbon by said drag motor, said dynamic braking circuit means comprising:

rectifying circuit means for rectifying feedback signals produced in phase windings of said drag motor in response to the pull of said ribbon on said drag motor, and current sink circuit means connected to the system for maintaining a constant current at a selected level from said rectifying circuit means dependent on the ribbon for controlling the dynamic braking of said drag motor.

6. A dynamic breaking circuit means according to claim 5 wherein said current sink circuit means compromises an emitter follower circuit connected to receive current from said rectifying circuit means, and an operational amplifier .circuit operatively connected to said emitter follower circuit for regulating the current drawn by the said emitter follower circuit from said rectifying means.

7. A dynamic braking apparatus for a drag motor of a motor of a ribbon tensioning system wherein said drag motor is driven to generate alternating feedback signals in response to pulling by said ribbon, comprising:

circuit means for rectifying including a diode bridge circuit having an input connected to the windings of said drag motor, current sink circuit means connected to the output of said rectifying circuit means, and control means for regulating the current level of said sink circuit means at predetermined selected levels for controlling dynamic braking of said drag motor.

8. A dynamic braking system for a polyphase permanent magnet step motor operated as a generator, comprising:

bridge rectifying circuit means connected to phase windings of said step motor, current sink circuit means connected to the output of said bridge rectifying circuit means, for maintaining a constant current from said phase windings at a selected adjustment level, and control circuit means connected to said current sink circuit means, for setting the level of current drawn by said current sink circuit means to control the braking of said motor.

9. A dynamic braking system in accordance with claim 8 wherein said current sink circuit means comprises an emitter follower circuit, and said control circuit means comprises an operational amplifier circuit operatively connected to said emitter follower circuit for controlling the current capacity of said emitter follower circuit.

10. A dynamic braking system in accordance with claim 9 wherein said emitter follower circuit includes a transistor and a load resistor connected in an emitter circuit of said transistor, said operational amplifier has a first input connected for receiving a voltage feed back signal from said load resistor of said emitter follower circuit and a second input connected for receiving a reference voltage for setting the current level of said emitter follower circuit, and control means for selectively varying said reference voltage to said operational amplifier for selectively changing the current level in said emitter follower circuit for controlling the braking of said motor.

11. A dynamic braking apparatus for a drag motor of a motor of a ribbon tensioning system wherein said drag motor is driven to generate alternating feedback signals in response to pulling by said ribbon, comprising:

circuit means for rectifying including a diode bridge circuit having an input connected to the windings of said drag motor, current sink circuit means connected to the output of said rectifying circuit means, and control means for regulating the current level of said sink circuit means at predetermined selected levels for controlling dynamic braking of said drag motor;

and in which the current is continuous and maintained at a constant selected level between current selections.

12. A ribbon tension controller for controlling the tension of a ribbon as it is transferred from a rotating supply spool to a rotating take-up spool, comprising:

alternating current generator means coupled to said supply spool for producing braking torque to resist the rotation of said supply spool, control means for producing a digital ribbon tension control signal related to the distribution of the amount of ribbon between said spools, and dynamic electrical braking means for dynamically varying the braking torque produced by said generator means, including:

bridge circuit means electrically coupled to said generator means for rectifying alternating back emf signals produced in the winding of said generator means in response to rotation of said supply spool and to current sink circuit means for receiving the rectified output of said bridge circuit means and for maintaining a constant current drawn from the windings at a selected level, and control means responsive to said digital tension control signal for selectively setting the level of current drawn by said current sink circuit means for controlling the tension on said ribbon.

13. A ribbon drive system in accordance with claim 12 wherein said control means for generating said digital ribbon tension control signal and said control means for selectively setting the current drawn by said current sink circuit means, comprise a microprocessor and memory means for storing drag value data that depend on tension loading and the physical properties of said ribbon.

14. A ribbon drive system in accordance with claim 13 wherein said control means for generating said digital ribbon tension control signal comprises input means for inputting a parameter related to said tension effecting loading of said ribbon to said microprocessor.

15. A ribbon drive system in accordance with claim 14 wherein said current sink comprises an emitter follower circuit connected to said rectifier circuit means, an operational amplifier connected to set the current drawn by said emitter follower circuit from said bridge circuit means, said control means for controlling the current drawn by said current sink circuit means comprises means for applying a reference voltage to said operational amplifier to set the current drawn by said emitter follower circuit, and means responsive to said digital control signal from said microprocessor for changing the reference voltage applied to said operational amplifier to change setting of current drawn by said emitter follower circuit.

16. A ribbon drive system in accordance with claim 15 wherein said means for changing said reference voltage comprises a resistor network connected to said operational amplifier and a reference voltage source, and switch means responsive to said digital control signals for switching elements of said resistor network for altering the setting the reference voltage applied to said operational amplifier.

17. A ribbon drive system in accordance with claim 16 wherein said switch means comprises binary switch means and digital control signals are derived by said microprocessor from drag values representing operating conditions experienced by and physical properties of said ribbon stored in said memory means.

* * * * *